United States Patent [19]

Spätle

[11] 4,194,944

[45] Mar. 25, 1980

[54] FEEDING APPARATUS FOR A FILM IN A HOT PRESS STAMPING MACHINE

[75] Inventor: Wilfried Spätle, Oberasbach, Fed. Rep. of Germany

[73] Assignee: Messrs. Leonhard Kurz, Furth, Fed. Rep. of Germany

[21] Appl. No.: 902,252

[22] Filed: May 2, 1978

[30] Foreign Application Priority Data

May 14, 1977 [DE] Fed. Rep. of Germany ..... 2721980

[51] Int. Cl.[2] ..... B44C 1/00

[52] U.S. Cl. ..... 156/540; 101/7; 101/8; 101/38 R; 156/230; 156/238

[58] Field of Search ..... 156/361, 540–542, 156/384, 475; 101/4, 5, 6, 7, 8, 25, 27, 38 R, 39, 40; 226/19, 21

[56] References Cited

U.S. PATENT DOCUMENTS

| | | | |
|---|---|---|---|
| 3,139,368 | 6/1964 | Flood | 156/542 X |
| 3,231,448 | 1/1966 | Flood | 156/542 |
| 3,313,667 | 4/1967 | Flood | 156/542 X |
| 3,483,063 | 12/1969 | Baines et al. | 156/542 X |
| 3,540,968 | 11/1970 | White | 156/542 X |
| 3,640,213 | 2/1972 | Schwartzbach | 101/38 R X |
| 3,718,517 | 2/1973 | Beul | 156/361 X |
| 3,867,881 | 2/1975 | Blattner | 156/540 X |
| 3,975,226 | 8/1976 | Boettcher | 156/361 X |

*Primary Examiner*—David A. Simmons

[57] ABSTRACT

In a laminating machine comprising an applicator roller at a substantially fixed location and a support movable relatively to said roller for an article which is to be laminated with a decorating film that is peeled off a composite web composed of said decorating film on a backing sheet, a feeding device for taking said web to said applicator roller, said feeding device comprising a supply reel for said web, means for axially displacing said supply reel substantially parallel to said applicator roller and a rotatable jockey roller for tensioning said web and disposed between said supply reel and applicator roller, said jockey roller being mounted for substantially vertical displacement as well as pivotal motion about a vertical axis and axial displacement in unison with said supply reel.

11 Claims, 6 Drawing Figures

FEEDING APPARATUS FOR A FILM IN A HOT PRESS STAMPING MACHINE

The invention relates to a feeding apparatus for a hot press stamping foil in a hot press stamping machine having a hot press stamping roller at a substantially fixed location and a carrier which is adapted to support an article to be decorated with said foil and which is displaceable with respect to said stamping roller, wherein said foil is passed from a suppy reel over at least one direction-changing roller to said stamping roller, whereafter a backing sheet of said foil runs to a winding reel.

In known hot press stamping machines such as those used for decorating the casings of television receivers by means of a foil, the foil is fed from a supply reel into the gap between the stamping roller and the face of the article to be decorated. The article or rather its face to be decorated is then passed under the stamping roller by appropriately moving the carrier, the stamping roller being effective to apply the decorating layer of the foil to said face under the action of appropriate heat and pressure. Downstream of the stamping roller, the backing sheet is then withdrawn to be coiled on a winding reel. With the aid of such a machine, it is readily possible to move the carrier so that several faces of an article that extend at an angle to one another can be decorated in one operation, provided that the article or casing in question does not possess an excessive conicity, i.e. provided that the developments of the casing at both of the side edges extending in the direction of motion are of substantially equal length. Tests have shown that it is possible to hot press stamp casings having a conicity of 1° to 1.5°. If the conicity of the casings or similar articles is greater, however, it has not hitherto been possible to apply the foil to a plurality of adjoining side walls in one operation. Instead, it has been necessary to decorate the individual side faces separately. This naturally leads to butt joints in the foil at the edges, which detract from a pleasing appearance and could also prove a source for surface damage.

It is therefore an object of the present invention to construct the feeding apparatus for a hot press stamping machine of the aforementioned kind so that it will be possible also to decorate in one continuous hot press stamping operation those articles of which the side faces are more inclined to each other, i.e. having a greater conicity, without forming butt joints at the edges between the side faces.

According to the invention, the said supply reel is axially displaceable substantially parallel to said stamping roller and, between said supply reel and stamping roller before application to a face of said article to be decorated, said foil is led over a jockey roller which is movable with said supply reel, is displaceable substantially parallel to itself to tension said foil, and is rotatably mounted about a transverse axis extending transversely to its rotary axis in the direction of displacement.

By means of such a feeding apparatus, it becomes possible to decorate in one operation a plurality of adjoining side faces of articles having a comparatively large conicity, for example the casings of television receivers. When decorating three adjoining side faces, the supply reel and jockey roller are displaced laterally so that the foil extends at a uniform inclination over the first side face, namely in a manner such that it is at right-angles to the edge at which two adjacent side faces meet. When applying the foil in the region of this edge, the supply reel and thus the jockey roller are brought to a central position at which the foil runs straight over the face to be decorated. As soon as this face has passed the hot press stamping roller, the backing sheet of the foil being wound up appropriately, the supply reel together with the jockey roller is advanced by a further step in the same direction so that the foil will again travel at right-angles to the next edge of the casing, thereby moving at an inclination over the face that is now being decorated. By proceeding in this manner, it is possible to avoid the formation of folds in the foil almost completely. Pivoting of the supply reel is unnecessary although provision is made for it. If the supply reel is only displaced laterally, the slight difference in angle can be balanced out on the one hand by reason of the fact that the foil is stretchable to a certain extent and on the other hand by the fact that the jockey roller can pivot accordingly. The extension in the path of the foil from the supply reel to the stamping roller prevents excessive stresses from being set up in the foil. It will be evident from the above that by proceeding in accordance with the present invention a conical article to be decorated, for example a television casing, can be uniformly enveloped by the foil, this having hitherto been impossible without the formation of folds.

The jockey roller may be installed at one of a number of positions. However, a particularly simple construction and advantageous guiding of the foil are obtained if the jockey roller is adjustable for height as well as rotatably mounted about a substantially vertical axis and the foil is passed about the underside of the jockey roller. In this embodiment the foil may be tensioned under the weight of the jockey roller which in that case merely rests on the foil.

Hot press stamping machines make use of foils of different widths. If the tension in the foil is brought about solely by the constant weight of the jockey roller, this would mean that narrower foils are more intensively stressed than broader foils. To achieve a measure of compensation in this respect, counterweights may be provided for setting the foil tension, which engage the jockey roller to lift same by way of at least one elongate member passing over direction-changing rollers. Different counterweights are then used depending on the width of the foil.

It has been found desirable for both ends of the jockey roller to be mounted in substantially vertical arms of a yoke which is mounted on a vertically movable support for rotation about a vertical axis. This construction provides the required mobility for the jockey roller but is nevertheless adequately strong.

With the jockey roller mounted in this manner, the elongate member of the counterweights may engage the yoke near one arm thereof and act on a transmission member serving simultaneously to actuate a second elongate member engaging the yoke near the other arm thereof. The transmission member is preferably a shaft carrying two fixed sprockets about which there pass chains which form said elongate members.

As already mentioned, the apparatus is particularly simple to construct if the jockey roller is arranged below the supply reel and thus also below the face of the article to be decorated. However, in this case means must be provided which enable the decorated articles to be removed without difficulty after the hot press stamping process and also enable a new article to be inserted.

For this purpose, with the jockey roller disposed below the article face in the operating position, provision is made for a cross-strut which extends over the width of the foil, is disposed beneath the path of the foil during the hot press stamping operation and, for the purpose of withdrawing the article from the machine, can be lifted between the jockey roller and the article to lie against the underside of the foil and above the article face. The cross-strut is preferably a roller at the end of at least one lever pivotable in a vertical plane.

Despite using the feeding apparatus according to the invention, it could under unfavourable circumstances be possible for folds to be created immediately upstream of the stamping roller. To ensure proper positioning of the foil on the article face in the vicinity of the stamping roller, a stripper for laterally smoothing the foil and situated upstream of the stamping roller in the path of the foil may be resiliently pressed against the foil.

Finally, it is within the scope of the present invention for the displacement of the supply reel and jockey roller to be controllable by means of a servo motor in dependence on the shape of the article to be decorated. The servo motor may for example be a hydraulic or pneumatic cylinder.

Other features, details and advantages of the invention will become apparent from the following description of a preferred example with reference to the accompanying drawings, wherein.

Figure 1:
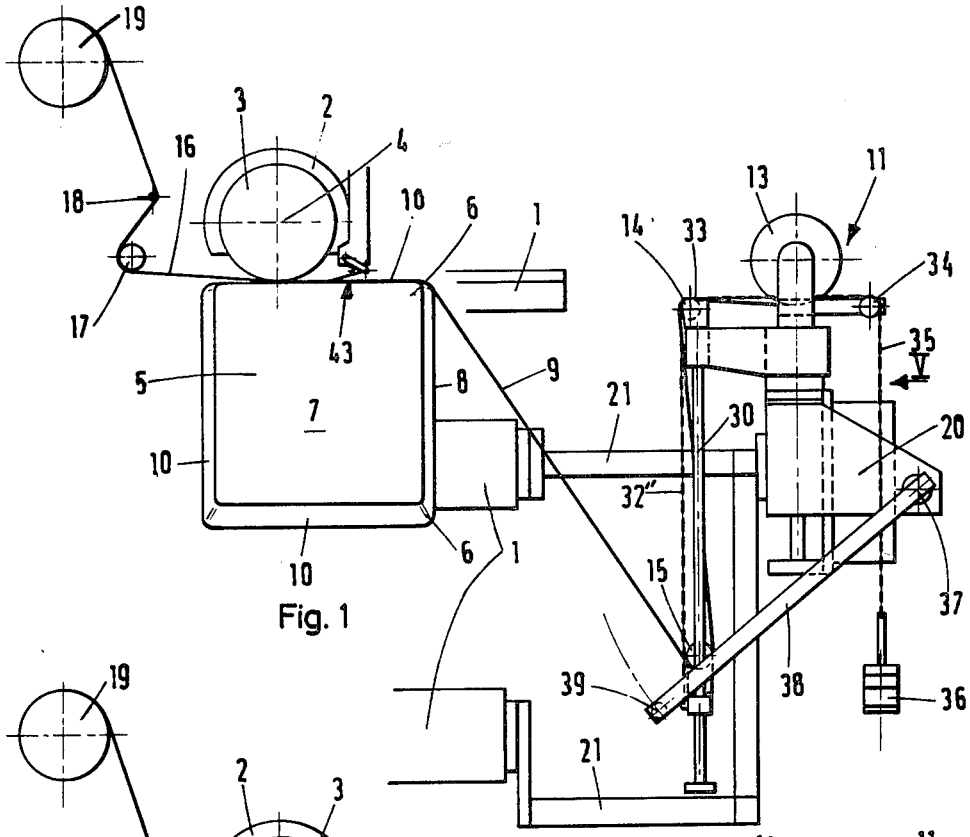
FIG. 1 is a diagrammatic side elevation of the feeding apparatus and the more important components of the hot press stamping machine during a hot press stamping operation.

The diagrammatic representations illustrate only those parts of the hot press stamping machine which are necessary for an understanding of the present invention, namely a portion 1 of the housing or frame of the machine, and a hot press stamping roller 3 which is provided with heating means 2 and is mounted at a substantially fixed position for rotation about a substantially horizontal rotary axis 4, means being provided (but not shown) for adjusting the pressure exerted by the stamping roller 3.

The article 5 to be decorated is mounted on a carrier 40. With the aid of appropriate control means, the carrier 40 is moved so that the side faces of the article 5 that are to be decorated, for example the sides, top and bottom of a television receiver casing are successively moved beneath the stamping roller 3. The motion of the carrier 40 is constituted by one advancing movement for each side face. As soon as one of the edges 6 of the article 5 has reached the stamping roller, the advancing movement is terminated and the article 5 is pivoted at a suitable radius so that the roller 3 will move closely about the surface of the edge 6, for which purpose the latter is desirably somewhat rounded.

If the hot press stamping machine is to decorate articles having substantially equal peripheries at their outer face 7 and inner face 8, i.e. articles which are not conical or only slightly conical, passing of the foil 9 uniformly about the side faces 10 of the article presents practically no difficulties. However, the position is different if the article is strongly conical as shown in the drawing, e.g. when the conicity is more than 1.5°. In that case if the foil 9 were simply passed about the side faces 10 of the article in a straight direction corresponding to that shown in FIG. 3, considerable folding of the foil would occur to detract from the appearance of the article.

To avoid such fold formation, the invention provides for a special feeding apparatus for the foil. This apparatus is generally indicated at 11 in FIGS. 1 to 5.

The feeding apparatus 11 comprises a supply reel 13 for the foil 9 coupled to a motor 12. This supply reel 13 is substantially horizontal and substantially parallel to the stamping roller 3. From the reel 13, the foil 9 moves substantially horizontally to a direction-changing roller 14. From the roller 14, the foil 9 is led substantially vertically downwardly to a jockey roller 15 of which the function and arrangement will hereinafter be described in more detail. From the jockey roller 15 the foil is then led obliquely upwardly during normal operation and arrives at the appropriate side face 10 of the article to be decorated, against which it is applied (see FIG. 1) and along which it reaches the underside of the stamping roller 3. After the face 10 of the article 5 has been coated with the foil, at which time the decorating layer is released from the backing sheet of the hot press stamping foil, the backing sheet 16 is led slightly obliquely upwardly away from the face 10 to a further direction-changing roller 17 and thence over a tensioning member 18 to a winding reel 19 for the backing sheet.

Figure 3:
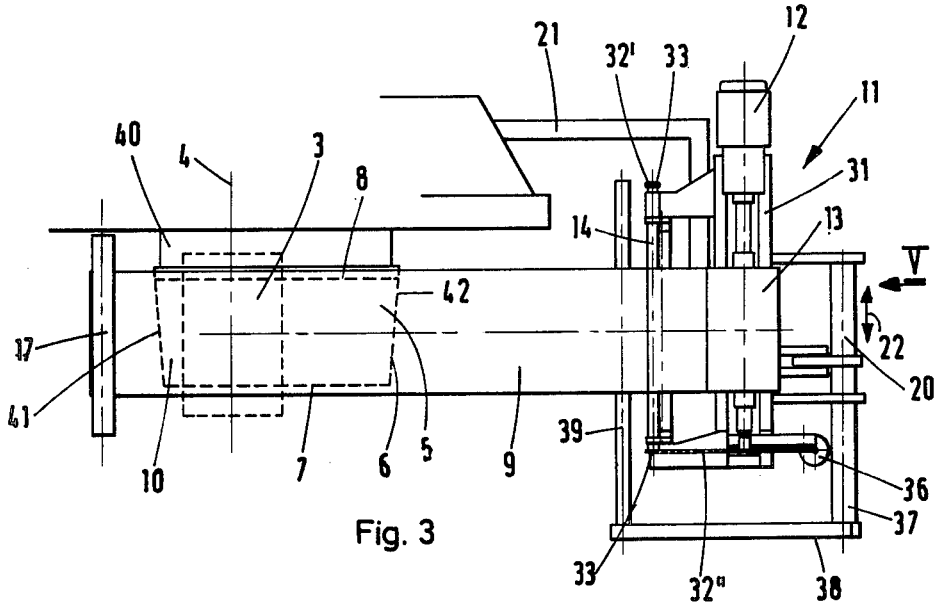
FIG. 3 is a diagrammatic plan view of the feeding apparatus and adjoining parts of the hot press stamping machine, the feeding apparatus being shown in a central position.
Figure 4:
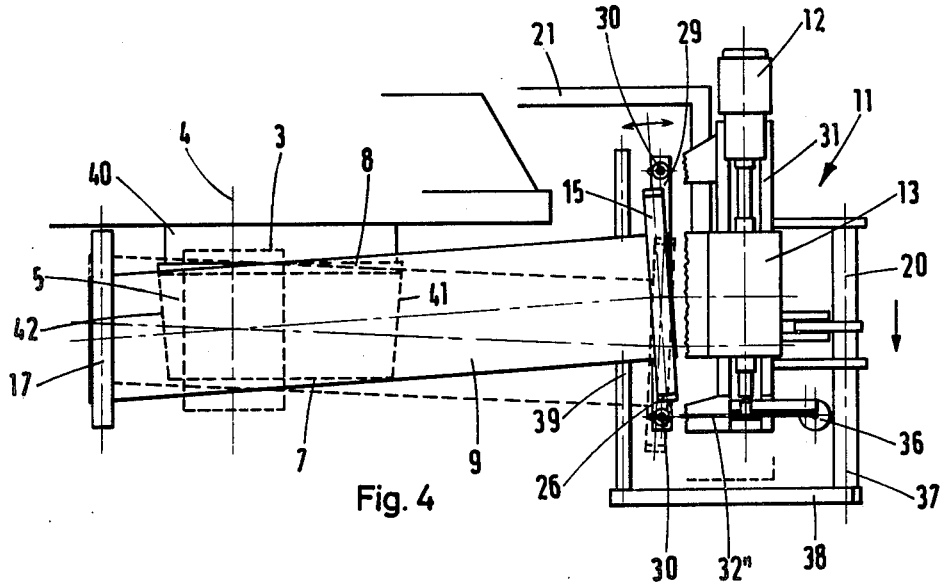
FIG. 4 is a view similar to FIG. 3 but with the feeding apparatus in positions assumed when decorating the first or third side face of the conical article.
Figure 5:
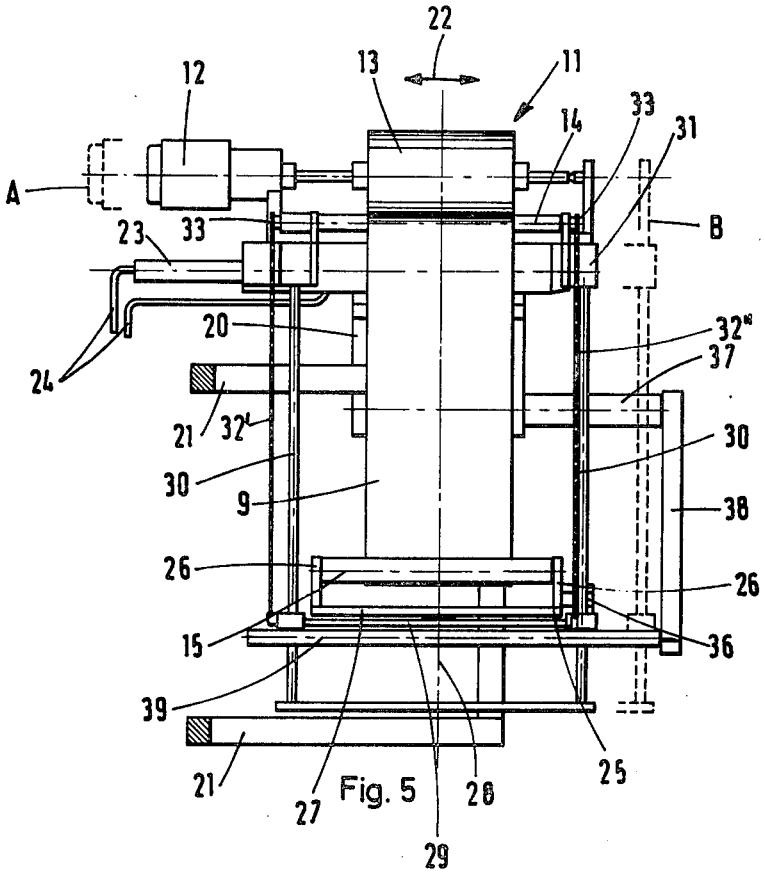
FIG. 5 is a diagrammatic end elevation of the apparatus taken in the direction of the arrow V in FIGS. 1 and 3.
Figure 6:
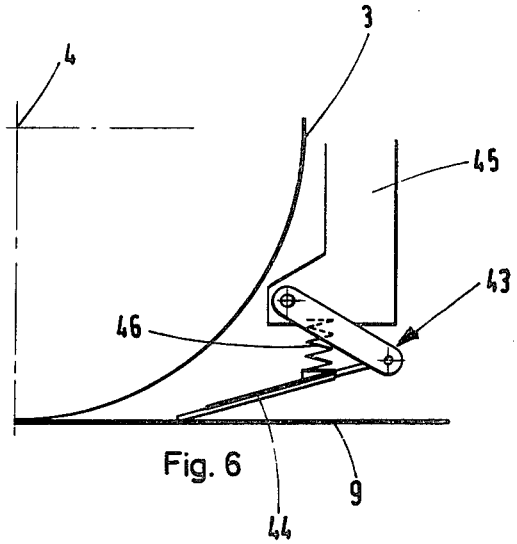
FIG. 6 is a diagrammatic enlarged side elevation of a stripper for the foil shown in FIGS. 1 and 2.

The important parts of the feeding apparatus 11, namely the supply reel 13, the direction-changing roller 14 as well as the jockey roller 15 and its mounting are horizontally displaceable relatively to the frame 20 in the direction of the arrow 22 in FIGS. 3 and 5, the frame 20 being connected by cross-members 21 to the frame of the machine proper. Such displacement will be particularly evident from a comparison of FIGS. 3 and 4. In FIG. 3 the parts are shown in a central position. In FIG. 4 the parts of the feeding apparatus 11 are shown in the upper limiting position in full lines and in the lower limiting position in broken lines. The limiting positions are also shown in broken lines at A and B, respectively, in FIG. 5.

Horizontal displacement of the supply reel 13 and the parts connected thereto (namely the motor 12, direction-changing roller 14, jockey roller 15) is effected by a hydraulic cylinder 23 which is shown in FIG. 5 and which is connected to hydraulic conduits 24.

With the feeding apparatus 11 according to the invention, the presence and mobility of the jockey roller 15 are particularly important. As will be particularly evident from FIG. 5, the jockey roller 15 is freely rotatable in the two vertical arms 26 of a yoke 25 of which the web 27 is pivotably mounted on a support 29 for movement about a vertical transverse axis 28. The support 29 is vertically displaceable along two guide rods 30 which pass through holes in the support 29. The guide rods 30 are fixed to the supporting members 31 for the supply reel 13, the motor 12 and the direction-changing roller 14. By means of the mounting as just described, the jockey roller 15 can thus be moved vertically as well as rotated about the transverse axis 28 so that it can always assume the most favourable position for guiding the foil 9.

At the two ends of the support 29 for the yoke 25 of the jockey roller 15 there is engaged a substantially vertically extending chain 32 which is likewise clearly shown in FIG. 5. The chains 32 pass about sprockets 33 in the vicinity of the direction-changing roller 14 for the purpose of changing their direction. The two sprockets 33 are interconnected so that they will always turn in unison.

Figure 2:
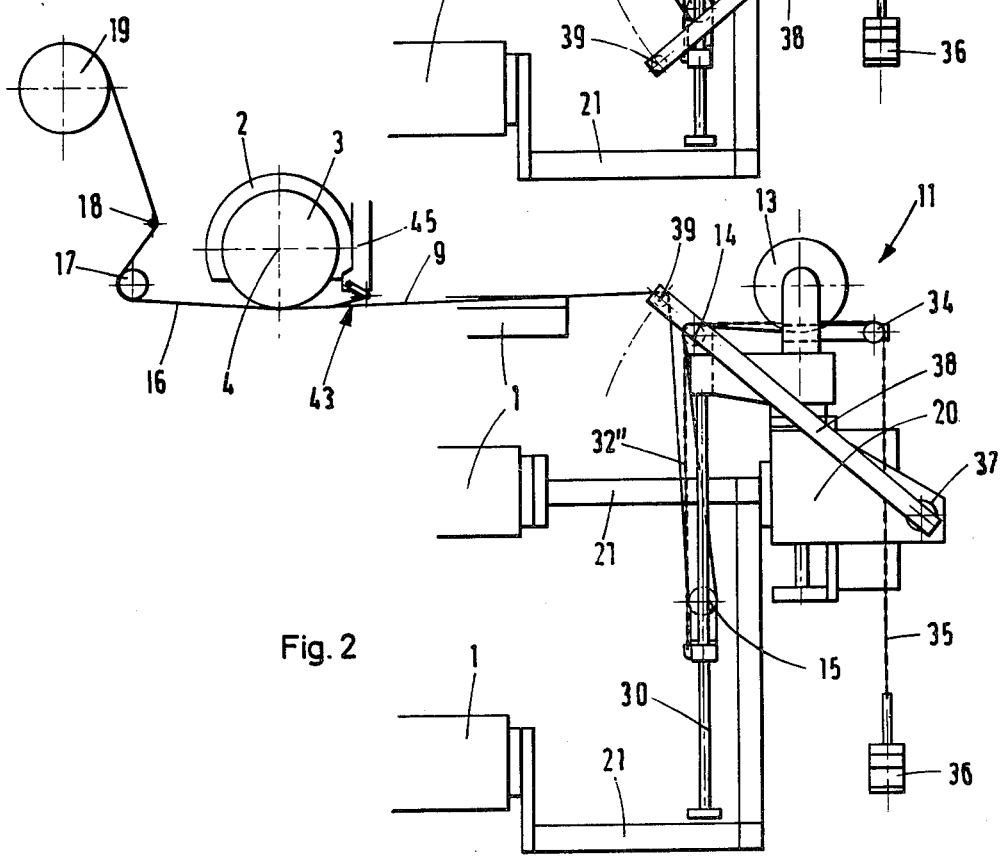
FIG. 2 is an elevation corresponding to FIG. 1 but showing the feeding apparatus in a position at which an article can be withdrawn or introduced.

The chain 32" at the right-hand side in FIG. 5, at the bottom in FIGS. 3 and 4 and also visible in FIGS. 1 and 2 is passed over a further sprocket 34 and then has its run 35 extending downwardly. At the lower end of the run 35 of the chain there may be counterweights 36.

The other chain 32' is an endless chain. By reason of coupling the two sprockets 33 and using this second chain 32', the support 29 for the jockey roller 15 is lifted uniformly at both ends even though counterweights are provided on only one chain 32" to reduce the effective weight of the jockey roller 15 and its supporting members.

The provision for attaching counterweights 36 is made in order to compensate for excessive stretching of the foil 9 which can have a varying width. It will be understood that, with the same weight for the jockey roller and its supporting structure, the stretching effect exerted on a narrower foil would be greater than for a broader foil. This can be compensated by the apparent reduction in the weight of the jockey roller and its supporting structure by way of attaching counterweights 36 of appropriate size.

A lever arm 38 is pivoted to the frame 20 at 37 on the side opposite the guide rods 30. This arm 38 can be raised and lowered, for example by means of a hydraulic cylinder or the like (FIGS. 1 and 2).

A cross-strut 39 in the form of a roller is secured to the free end of the lever arm 38. The length of the cross-strut 39, and this will be readily seen from FIGS. 3 and 5, is selected so that it extends over the entire range that can be covered by the foil 9.

Whereas during normal operation (FIG. 1) the cross-strut 39 is disposed at a spacing below the length of foil 9 extending from the jockey roller 15 to the article 5, the lever arm 38 and cross-strut or roller 39 can be swung upwardly to such an extent that the cross-strut 39 engages the underside of the foil and then guides it so that the foil extends slightly obliquely downwardly towards the stamping roller 3. In this position, the decorated article can be readily withdrawn from the machine and a new article inserted. The swing arm 38 is therefore pivoted to the position of FIG. 2 only at the end of each hot press stamping operation whereas it is normally in the FIG. 1 position.

The apparatus of the invention operates as follows.

It is assumed that an article 5 having a non-parallelepiped shape as shown in FIGS. 3 and 4 is to be coated with a hot press stamping foil at three side faces. After the article has been secured in the position according to FIG. 4, the hydraulic cylinder 23 is actuated to move the supply reel 13 together with the motor 12 and jockey roller 15 to the limiting position shown in broken lines in FIG. 4. This causes the foil 9 to extend at right-angles to the edge 41 of the article, as also shown in broken lines in FIG. 4. The first face 10 of the article is now coated by advancing the carrier 40 so that the article is moved beneath the stamping roller 3. As soon as the article has been moved to the left in FIG. 4 to an extent such that the right-hand edge 41 in FIG. 4 is disposed beneath the stamping roller 3, further advancing movement of the article 5 is terminated and the carrier 40 is operated to swing the article about the edge 41. Simultaneously, the hydraulic cylinder 23 is actuated so that the movable parts 13, 14, 15 of the feeding apparatus 11 are brought to the central position shown in FIG. 3. Instead of moving obliquely across the first face 10 to be coated as shown in broken lines in FIG. 4, the foil 9 now moves straight substantially parallel to the front and rear edges of the article 5 as shown in FIG. 3.

The carrier 40 again takes the article 5 to the left in FIG. 3 until the trailing edge 42 of the article in FIG. 3 is disposed beneath the stamping roller 3. The article is thereupon again pivoted, this time about the edge 42. By appropriately actuating the hydraulic cylinder 23 it is also ensured that the supply reel 13 together with the motor 12, jockey roller 15 and direction-changing roller 14 reach the upper limiting position shown in full lines in FIG. 4, at which time the foil 9 again extends uniformly obliquely across the side face to be decorated, namely substantially at right-angles to the edge 42. The third face of the article is then decorated whilst the article is being fed beneath the stamping roller 3.

As soon as the trailing edge of the last face to be decorated has been swept by the stamping roller, an appropriate control pulse causes the lever 38 and its cross-strut 39 to be swung upwardly to the position shown in FIG. 2, whereby the article is separated from the foil. The article can now be withdrawn and a new article clamped in the machine.

Experiments have shown that under unfavourable operating conditions folds can occasionally be formed in the foil upstream of the stamping roller 3 despite the special feeding apparatus. To exclude any difficulties that may arise, a stripper 43 is therefore provided in the path of the foil 9 upstream of the stamping roller 3, the stripper being resiliently pressed downwardly. This stripper 43 is moved so that, upon tilting of the casing or article, the stripper 43 is applied to the next following planar face and executes a sweeping motion on the face in a direction away from the stamping roller, whereby slight corrugations or folds are smooth out.

The stripper 43 comprises a pressure plate 44 mounted on a carrier 45 which serves to apply and withdraw the stripper 43. The application of the pressure plate 44 is effected by a spring 46.

It will be evident particularly from FIG. 4 that the jockey roller 15 is automatically set to suit the hot press stamping process that is just being performed. As shown for example in FIG. 2, the jockey roller 15 can also readily move upwards and downwards to keep the foil at a uniform tension. By reason of the rotatability of the jockey roller 15 about the axis 28 it is unnecessary also to turn the supply reel 13. Compensation in this respect is provided in that the length of the foil between the direction-changing roller 14 and the article 5 is comparatively large.

I claim:

1. A feeding apparatus for application of foil in a hot press stamping machine having a hot press stamping roller at a substantially fixed location and carrier means adapted to support an article to be decorated with said foil and which is displaceable with respect to said stamping roller, comprising a supply reel for feeding said foil mounted on a backing sheet, at least one direction changing roller between said supply reel and said stamping roller and over which said foil is passed, a take up reel for receiving and collecting the backing sheet after passing the stamping roller, said supply reel being axially displaceable substantially parallel to said stamping roller, and between said supply reel and stamping roller before application to a face of said article to be decorated, sand foil is led over a jockey roller which is moveable with said supply reel, is displaceable substantially parallel to itself to tension said foil, and is rotatably mounted about an axis extending transversely to its rotary axis in the direction of displacement.

2. Apparatus according to claim 1 wherein at least one counterweight is connected to said jockey roller to lift the same and set the foil tension.

3. Apparatus according to claim 1, wherein said jockey roller is adjustable for height and rotatably mounted about a substantially vertical axis, and said foil is passed about the underside of said jockey roller.

4. Apparatus according to claims 1 and 3, wherein said foil is tensioned under the weight of said jockey roller.

5. Apparatus according to claim 1, wherein both ends of said jockey roller are mounted in substantially vertical arms of a yoke which is mounted on a vertically movable support for rotation about a vertical axis.

6. Apparatus according to claim 5, wherein at least one counter weight is connected to said jockey roller yoke near one of its arms by means of an elongated member passing over directional changing rollers, said elongated member serving as a transmission means simultaneously to actuate a second elongated member engaging said yoke near the other of its arms.

7. Apparatus according to claim 6, wherein said transmission member is a shaft having two sprockets fixed to it about which there pass chains which form said elongate members.

8. Apparatus according to claim 1, which includes a cross-strut extending over the width of the foil and disposed beneath the foil between the jockey roller and the stamping roller, out of contact with the foil during stamping of the article and elevatable to contact and lift the foil above the upper face of the article during feeding and removal of the article from the apparatus.

9. Apparatus according to claim 8, wherein said cross-strut is a roller at the end of at least one lever pivotable in a vertical plane.

10. Apparatus according to claim 1, wherein a stripper is provided upstream of said stamping roller and adapted to be resiliently pressed against the foil for laterally smoothing the same before hot pressing.

11. Apparatus according to claim 1, wherein displacement of said supply reel and jockey roller is controlled by means of a servo motor responsive to the shape of the article to be decorated.

* * * * *